United States Patent [19]

Chapin et al.

[11] Patent Number: 4,881,894

[45] Date of Patent: Nov. 21, 1989

[54] SELF-IGNITING PORTABLE TORCH ASSEMBLY

[75] Inventors: David S. Chapin, Raleigh, N.C.; Gil Farnham; Al Burgin, both of Sycamore, Ill.

[73] Assignee: Cooper Industries, Inc., Houston, Tex.

[21] Appl. No.: 155,783

[22] Filed: Feb. 16, 1988

[51] Int. Cl.[4] ..... F23Q 7/12

[52] U.S. Cl. ..... 431/255

[58] Field of Search ..... 431/255

[56] References Cited

U.S. PATENT DOCUMENTS

| | | | |
|---|---|---|---|
| 3,655,324 | 4/1972 | Schweitzer | 431/258 |
| 3,694,134 | 9/1972 | Ross | 431/255 |
| 3,802,828 | 4/1974 | Mercer | 431/255 |
| 3,984,738 | 10/1976 | Mohr | 431/255 |
| 4,325,356 | 4/1982 | Taschler | 431/263 |
| 4,348,172 | 9/1982 | Miller | 431/255 |
| 4,526,532 | 7/1985 | Nelson | 431/255 |
| 4,538,983 | 9/1985 | Zeller et al. | 431/255 |
| 4,666,399 | 5/1987 | Nelson | 431/264 |

*Primary Examiner*—Carroll B. Dority, Jr.

*Attorney, Agent, or Firm*—Alan R. Thiele; Eddie E. Scott

[57] ABSTRACT

A self-igniting portable torch includes source of electrical potential mounted on the outside of the torch tip downstream of the orifice in a heat resistant housing and an electrode which extends into the mixing chamber. The source of electrical potential and the electrode are electrically coupled by a connector contained entirely within the torch tip.

10 Claims, 3 Drawing Sheets

Fig. 3
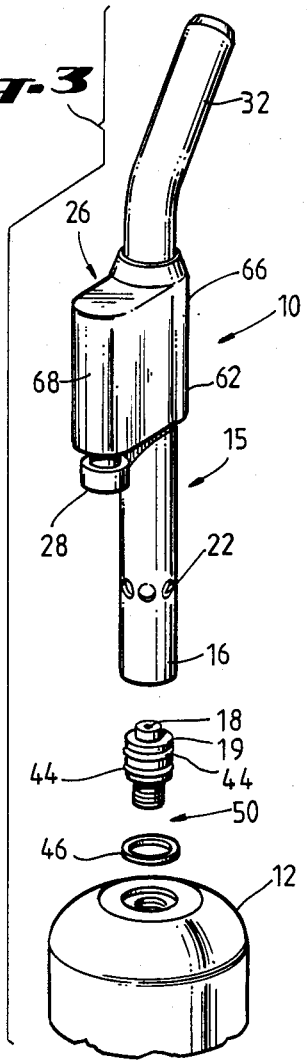
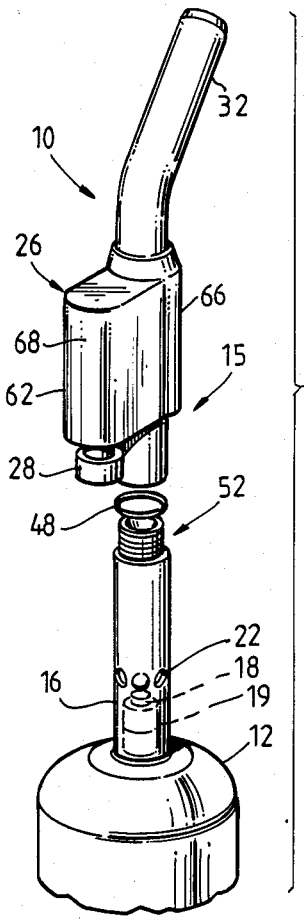
Fig. 4
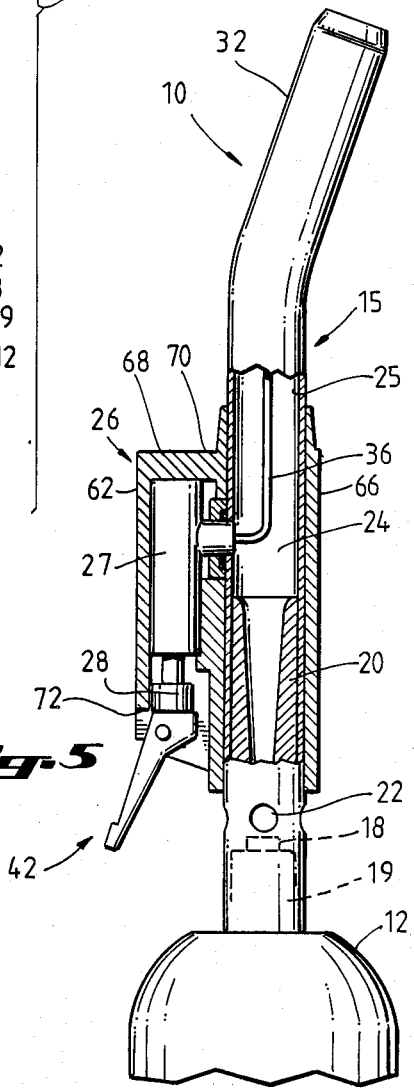
Fig. 5
Fig. 6
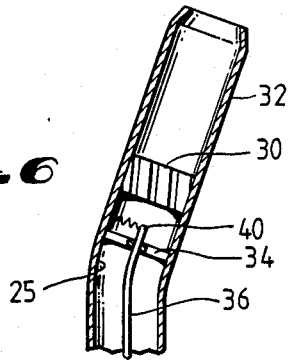

SELF-IGNITING PORTABLE TORCH ASSEMBLY

BACKGROUND OF THE INVENTION

The present invention relates to a portable torch assembly, more particularly to a self-igniting or instant igniting portable torch assembly.

The concept of having a self-igniting or instant igniting portable torch assembly provides a great convenience to the user as it eliminates the need for carrying a portable hand-held sparker or a cigarette lighter to ignite the pressurized flammable fluid which supports the flame emanating from the burner or torch tip of the portable torch assembly.

Prior art self-igniting or instant igniting portable torch assemblies have tended to be complex devices wherein a spark producing electrode is extended int the mixing chamber or burn tube of the torch tip. The source of electrical energy to produce the spark is typically located away from the spark producing electrode. The combined electrode and power source are typically called piezoelectric igniters. Herein the mechanical distortion of a crystal produces an electrical potential sufficient to produce a spark.

In prior art torch assemblies the remote location of the piezoelectric igniter has necessitated complex conducting paths for electrical energy from the crystal to the most desirable spark location. The use of complex conducting paths raises the cost of producing the torch. Additionally such complete conducting paths have made the torches difficult to operate because of the inconvenient location of the manual piezoelectric igniter activator button.

There is therefore a need in the art to provide an inexpensive portable torch assembly with a simplified conducting path wherein the activator button for the piezoelectric igniter is in a convenient location.

Many prior art torches have run electrical connections between the source of electrical potential and the spark producing electrode outside of the torch tip This configuration greatly increases the exposure of the electrical connections to damage.

There is therefore an additional need in the art to provide a portable torch assembly with protected electrical connections between the piezoelectric crystal and the spark producing electrode.

Exemplary of prior art self igniting torch assemblies are the following:

U.S. Pat. No. 3,655,324 to Schweitzer teaches an impact type piezoelectric igniter element spring located in a casing with a manual actuator mounted around the air hole inlets and electrical connections positioned in an unprotected location on the outside of the torch tip.

U.S. Pat. No. 3,802,828 to Mercer et al. teaches an automatically activated piezoelectric crystal type burner igniter whose hammer is driven b pressurized fluid.

U.S. Pat. No. 4,325,356 to Taschler teaches external connections for a piezoelectric spark generator for use on a gas fired soldering iron.

U.S. Pat. No. 4,348,172 to Miller teaches a complex externally connected combination piezoelectric igniter and control valve. The manual activator button is co-located with the valve which is mounted to the container of combustible fluid upstream from the orifice.

U.S. Pat. No. 4,526,532 to Nelson teaches an externally connected piezoelectric igniter on a torch having an orifice and burner tube which are removable with respect to the orifice tube.

U.S. Pat. No. 4,666,399 to Nelson teaches a torch tip with internally run electrical connections and a remotely located piezoelectric activator button similar to the configuration found in U.S. Pat. No. 4,348,172 to Miller.

Consequently, there remains a need in the art to provide a self-igniting portable torch that has a simplified path for conducting electricity from the piezoelectric crystal to the location for the spark; does not employ external connections between a piezoelectric igniter and a spark producing electrode; and places the activator button for the piezoelectric igniter in a convenient location.

SUMMARY OF THE INVENTION

The self-igniting portable torch assembly of the present invention eliminates external connections between the source of electrical potential and the spark producing electrode as well as providing a simplified path for the flow of electricity by both mounting the piezoelectric igniter on the torch tip and passing the electrical connections for the spark producing electrode only through the torch tip assembly. The mounting of the piezoelectric igniter downstream from the orifice on the outside of the torch tip in a heat resistant housing enables the manual activator button for the piezoelectric igniter to be placed in a convenient location. Such an arrangement also facilitates the easy replacement of torch tip assemblies with torch tip assemblies which allow for different flame configurations. This is due to the self contained nature of the electrical spark generator system. Since the complete system is attached to the tip, there is no worry about re-attaching electrical contact improperly while changing tips.

The self-igniting portable torch assembly of the present invention includes a orifice which regulates the flow of pressurized combustible or flammable fluid from a fluid source or storage container. The pressurized combustible fluid, once having passed through the orifice is mixed with air or oxygen. The air or oxygen is then caused to enter the stream of pressurized combustible fluid by means of a jet pump which uses the velocity of the fluid to draw ambient air or raw oxygen into the torch tip assembly. Once the air or oxygen is drawn into the flow of pressurized combustible fluid it then passes into a mixing chamber. The mixing chamber causes the air or oxygen and the pressurized combustible fluid to form a highly volatile mixture. When a spark is introduced into the mixing chamber the volatile mixture ignites and a flame is produced. The position an shape of the flame is controlled by a flame holder and burn tube at the end of the torch tip assembly.

A piezoelectric igniter is mounted in a heat resistant housing on the torch tip assembly downstream from the orifice. The piezoelectric igniter generates electrical energy by transforming the motion of a striker, which deforms a crystal, into an electrical potential. This piezoelectric igniter transmits the electrical potential through an electrical connector within the torch tip assembly to the place where the spark may ignite the flowing volatile gaseous mixture. When the piezoelectric crystal is activated, a spark is produced within the torch tip. The flowing volatile gases are ignited by the spark and the resulting flame is stabilized on the flame holder portion of the torch tip assembly.

BRIEF DESCRIPTION OF THE DRAWINGS

A better understanding of the self-igniting portable torch assembly of the present invention may be had by reference to the figures wherein:

FIG. 3 is a partially exploded view of the portable self-igniting torch assembly;

FIG. 4 is a view similar to FIG. 3 showing a partially exploded view;

FIG. 5 is a side elevational view similar to FIG. 2 showing an alternate method of activating the igniter;

FIG. 6 is a perspective view of the region where the spark is produced;

DETAILED DESCRIPTION OF THE EMBODIMENTS

The self-igniting portable torch assembly 10 of the present invention will be explained using the illustrative example of self-contained portable propane torch assembly. While the instant invention is explained in conjunction with a self-contained portable propane torch assembly, it will be understood that the present invention may also be utilized with larger welding torches where the source of combustible fluid is not necessarily self-contained but is separated from the torch tip. Such torches and separable pressurized fluid supplies are commonly used with heavy welding equipment.

Figure 1:
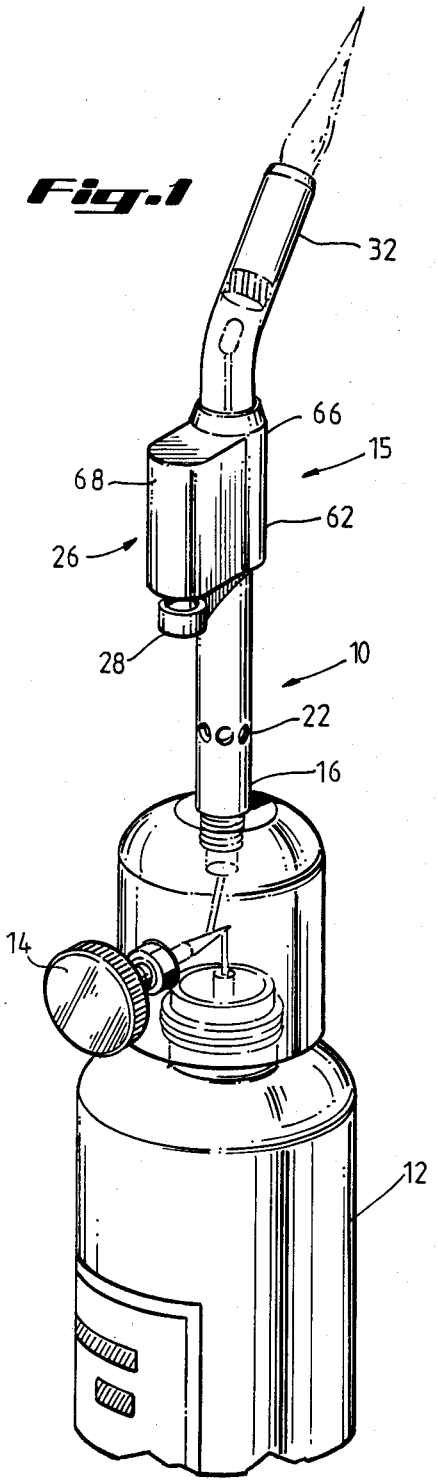
FIG. 1 is a perspective view of the self-igniting portable torch assembly of the present invention.
Figure 2:
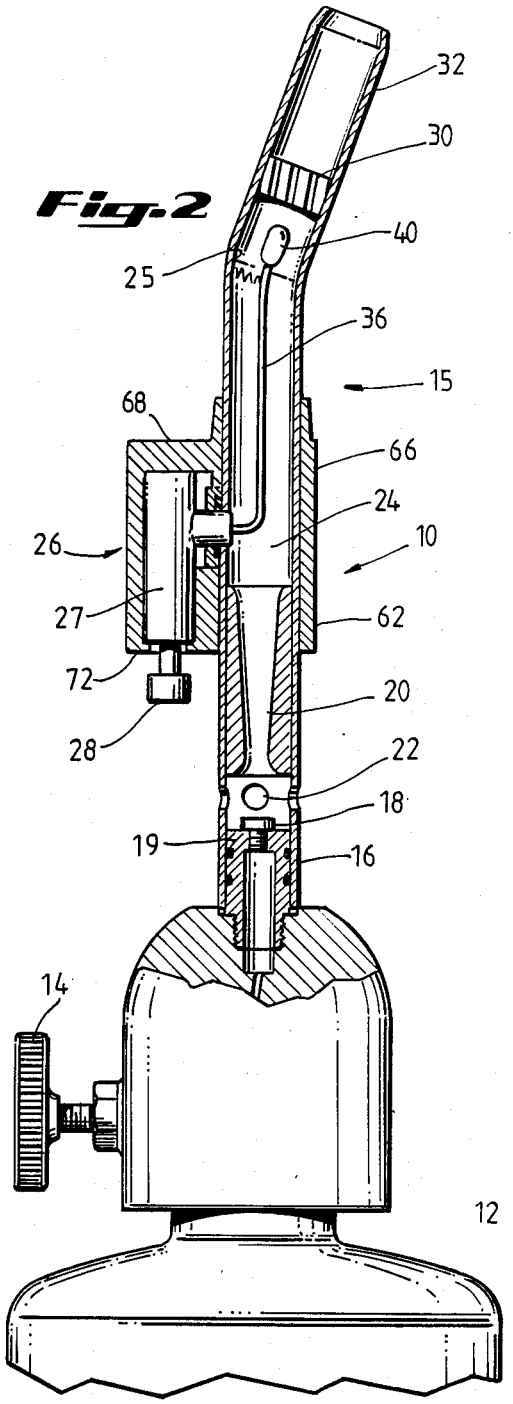
FIG. 2 is a side elevational view, in partial section of the self-igniting portable torch assembly shown in FIG. 1.

As may be seen by reference to FIGS. 1 and 2 a self-contained portable propane torch assembly 10 typically consists of the following basic elements: a source of pressurized combustible fluid 12, a valve 14 and a torch tip assembly 15. Torch tip assembly 15 is typically a tubular member placed downstream from source 12 and valve 14. The pressurized fluid, herein propane gas, is allowed to exit container 12 when valve 14 is opened. Valve 14 controls the flow of pressurized propane through connection tube 16 to orifice 18. Connecting tube 16 forms the first part of the tubular member in torch tip assembly 15 Orifice 18 is positioned with orifice holder 19 and is particularly important as it i orifice 18 which provides a constant velocity flow of propane or of combustible fluid into mixing chamber 24.

To assist in the burning of propane or the combustible fluid, it is necessary that air or oxygen enter torch tip assembly 15. This is accomplished in the second portion of the tubular member. The addition of air or oxygen normally takes place in mixing chamber 24 downstream from orifice 18. Air or oxygen is drawn into torch tip assembly 15 from the environment by use of a nozzle jet pump 20 which creates a partial vacuum by the nozzle effect on the flowing combustible gas. This partial vacuum draws in air or oxygen through intake holes 22. Air or oxygen is then combined with the pressurized combustible fluid in mixing chamber 24. In welding equipment raw oxygen is obtained from a source of pressurized oxygen. The precise size of orifice 18 establishes the correct fluid flow velocity so that nozzle jet pump 20 draws in sufficient quantity of air or oxygen to support a usable flame.

Mounted downstream from orifice 18 in housing 62 on the outside of torch tip assembly 15 is a igniter assembly 26 for producing a spark. Such igniters are typically of the piezoelectric type. The piezoelectric igniter used herein is of a standard design similar to that shown in U.S. Pat. No. 3,984,738. It includes a housing for the crystal 27 and wire or electrical connector 36.

Connection housing 62 is made from a heat resistant, electrically non-conductive plastic or similar material so that the heat generated in torch tip assembly 15 will not damage housing 27. As may be best seen by reference to FIGS. 2 and 5, connection housing 62 includes an extended tubular portion 66 which is of sufficient size to fit tightly around torch tip assembly 15. Formed integrally with tubular portion 66 is igniter containing portion 68. Wall 70 separates tubular portion 66 and igniter containing portion 68. The thickness of wall 70 prevent the heat generated within torch tip assembly 15 from damaging housing 27, prevents the piezoelectric igniter from shorting out and assists in positioning the igniter s that it does not disrupt the flow of flammable fluid. One end 72 of igniter containing portion 68 is open so that manual button 28 is positioned for easy access by the user.

In one embodiment, the end of connector 36 is positioned by holder 34 as shown in FIG. 6. At the end of connector 36 is a ceramic insulating cap 40. In order for piezoelectric igniter 26 to operate, a complete electrical circuit must be formed. This is accomplished by placing wire 36 in the path of the flowing volatile fluid and causing a spark to jump from wire 36 to the interior wall 25 of mixing chamber 24.

Figure 8:
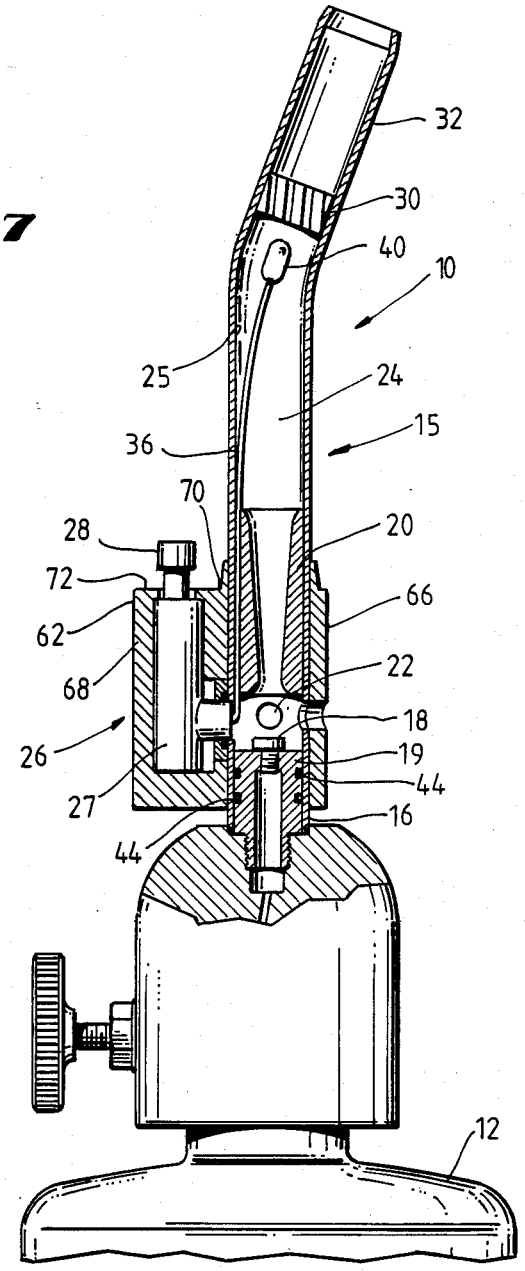
FIG. 8 is a view similar to FIG. 2 showing an alternate method of construction.

Another embodiment is shown in FIG. 8 where the holder 34 has been eliminated. Herein the inherent stiffness of wire 36 places wire 36 at the proper location with torch tip assembly 15.

Igniter 26 is manually activated by button 28. When button 28 is pushed, the flow of electrical potential through connector 36 causes a spark to jump from wire 36 to inside wall 25. Location of the spark is controlled by a pin-hole made in the insulation surrounding wire 36. The mixture of the combustible gas and air or oxygen then ignites into a flame. If desired a lever assembly 42 as shown in FIG. 5 may be used to push button 28.

The continuing flow of pressurized fluid and air or oxygen causes the flame to stabilize at flame holder 30 which is mounted in the third portion of the tubular housing. Flame holder 30 both stabilizes the base of the flame and fixes the flame in position with respect to torch tip assembly 15. As shown in FIG. 1, extending from flame holder 30 is flame tube 32 which shapes the flame. Wire 36 is entirely contained within mixing chamber 24. This mounting protects the electrical connections over portable torches where the connections are mounted externally of the mixing chamber. An alternate method of mounting the piezoelectric igniter 26 is shown in FIG. 8. Herein housing 27 is mounted closer to source 12. Connector 36 passes outside of nozzle jet pump 20 along interior wall 25. The design of torch tip assembly 15, less the piezoelectric igniter is similar in some respects to that marketed by the Turner Torch Division of CooperTools, a marketing arm of Cooper Industries under part number PR3600 or LP5555.

Figure 7:
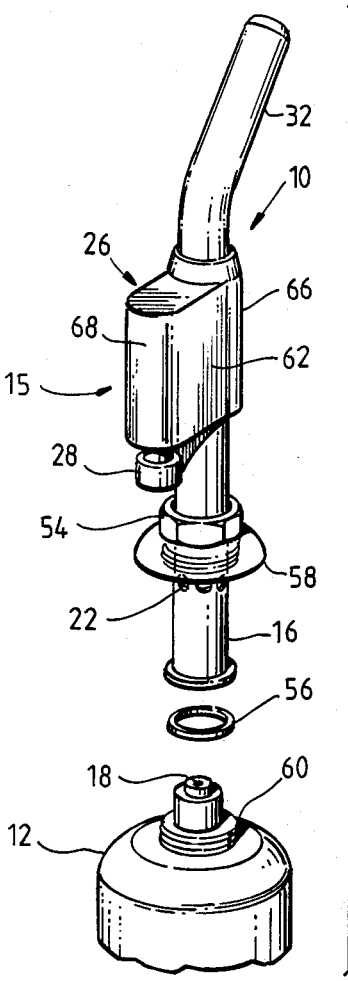
FIG. 7 is a perspective view of an alternate mounting of the torch tip.

FIGS. 3 and 4 illustrate the seals formed at the various threaded connections 50 and 52 within torch tip assembly 15. In FIG. 3 it may be seen that orifice holder 19 is surrounded by two o-rings 44 which seal against the inside of connecting tube 16. Washer 46 provides additional sealing for threaded connection 50. Similarly washer 48 provides a sealing effect for threaded connection 52. FIG. 7 illustrates an alternate method of connecting torch tip assembly 15 to source 12. Therein a lock nut 54 is threadably connected to male fitting 60 on top of source 12. A seal is provided by the action of washer 56 against flange 58.

OPERATION

When it is desired to ignite the portable self-igniting torch assembly 10 the pressurized combustible fluid is caused to flow from container 12 by opening valve 14. In the device shown in the figures, the container is a small propane gas tank. In a welding torch the container may be a large source of combustible fluid. When the combustible fluid flows from its container it enters torch tip 15. After entering torch tip 15, air or oxygen must be added to the flowing combustible gas to produce a usable flame. This is accomplished by drawing in air or oxygen through holes 22. When the oxygen and combustible gas are mixed together, a highly volatile mixture is formed. This highly volatile mixture is ignited by a spark which is introduced into the flow path of the volatile mixture. The spark is caused by an electrical potential completing a circuit between wire 36 and wall 25. The placement of the spark is governed by making a small hole in the insulation around wire 36. Cap 40 prevent the spark from emanating from the end of wire 36.

It has been found that if wire 36 passes within torch tip assembly 15 it is protected. This provides an advantage to the user a rough handling of the torch assembly 10 will not break the electrical connection between housing 27 and wire 36.

Additionally, it has been found that mounting piezoelectric igniter assembly 26 higher up on torch tip 15 in heat resistant housing 62 so that it is downstream of orifice 18 places manually activated button 28 in a much more convenient location for the torch user. It has been found that such placement lowers the manufacturing costs. In addition, this placement provide for easy changing of tips (from large to small, for example) by providing a self contained electrical ignition system in a permanently attached position to each tip.

There is thereby provided by the portable torch assembly 10 of the present invention a torch with internal connections for the piezoelectric igniter and a conveniently mounted manual activator button for a piezoelectric igniter.

While the self-igniting portable torch assembly 10 of the present invention has been described with reference to the preferred embodiments, it is understood that the additional embodiments of this invention will become apparent to those of ordinary skill in the art once having read the foregoing specification. Such additional embodiments are within the scope of the appended claims.

What is claimed is:

1. A torch tip for connection to a source of pressurized flammable fluid comprising in operative combination:

mean for regulating the flow of the pressurized flammable fluid contained within the first portion of a tubular member;

means for drawing oxygen into the flow of the pressurized flammable fluid contained within a second portion of said tubular member;

a mixing chamber for combining the pressurized flammable fluid and oxygen contained within a third portion of said tubular member;

a flame holder located at one end of said mixing chamber;

means for producing an electrical potential mounted on the exterior of said tubular member downstream from said means for regulating the flow of the pressurized flammable fluid in a heat resistant housing;

a burn tube extending from said flame holder away from said mixing chamber;

means for producing a spark in said mixing chamber;

means for conducting electric current from said means for producing an electrical potential to said means for producing a spark, said means for conducting electrical current being contained entirely within said tubular member.

2. A torch comprising:

a container for holding a pressurized source of combustible fluid;

a valve affixed to said container for regulating the flow of said combustible fluid from said container;

means for regulating the flow of the pressurized combustible fluid contained within the first portion of a tubular member;

means for drawing oxygen into the flow of the pressurized combustible fluid contained within a second portion of said tubular member;

a mixing chamber for combining the pressurized combustible fluid and oxygen contained within a third portion of said tubular member;

a flame holder located at one end of said mixing chamber;

means for producing an electrical potential mounted on the exterior of said tubular member downstream from said mean for regulating the flow of the pressurized flammable fluid in a heat resistant housing;

a burn tube extending from said flame holder away from said mixing chamber;

means for producing a spark in said mixing chamber;

means for conducting electric current from said means for producing an electrical potential to said means for producing a spark, said means for conducting electrical current being contained entirely within said tubular member.

3. The torch as defined in claim 1 wherein said means for producing an electrical potential and said means for producing a spark form a piezoelectric igniter.

4. A method for lighting a torch having a source of pressurized combustible fluid and a torch tip which includes a tubular housing, an orifice, a jet pump and a mixing chamber the method comprising the steps of:

affixing means for producing an electrical potential exterior of the tubular housing of the torch tip downstream of the orifice in a heat resistant housing;

providing a spark producing electrode in said mixing chamber;

connecting said a spark producing electrode to said means for producing an electrical potential entirely within the tubular housing;

producing a spark at said spark producing electrode.

5. In a torch tip having a means for regulating the flow of a pressurized combustible fluid, means for causing oxygen to mix with the flow of said pressurized combustible fluid, a chamber for mixing said pressurized combustible fluid and oxygen, and a flame holder contained within a tubular housing, the improvement comprising:

affixing means for producing an electrical potential to the exterior of the said tubular housing downstream from said means for regulating the flow of a pressurized combustible fluid in a heat resistant housing;

providing means for producing a spark in said mixing chamber; and electrically connecting said means for producing an electrical potential to said means for producing a spark entirely within said tubular housing.

6. The improvement as defined in claim 5 wherein said means for producing an electrical potential and said means for producing a spark is a piezoelectric igniter.

7. The improvement defined in claim 6 wherein said heat resistant housing includes a tubular portion constructed and arranged to surround the torch tip and a portion to store a source of electrical potential.

8. The improvement defined in claim 7 wherein said tubular portion and said storage portion are separated by a wall.

9. The improvement as defined in claim 8 wherein one end of said storage portion is open.

10. The improvement as defined in claim 9 wherein a lever actuating assembly is mounted on said open end.

* * * * *